United States Patent [19]

Cooper et al.

[11] 4,040,371

[45] Aug. 9, 1977

[54] POLYSILOXANE COATED POLYESTER FIBERS BLENDED WITH OTHER FIBERS TO OBTAIN FIBROUS MASS HAVING MORE ACCEPTABLE FLAME RESISTANCE THAN A MASS OF UNBLENDED POLYSILOXANE COATED FIBERS

[75] Inventors: John LaMonte Cooper, West Grove, Pa.; James Alvis Newnam, Hockessin, Del.

[73] Assignee: E. I. Du Pont de Nemours and Company, Wilmington, Del.

[21] Appl. No.: 671,278

[22] Filed: Mar. 29, 1976

[51] Int. Cl.[2] ..... A47G 9/02; A47G 9/08; B32B 7/08; B32B 27/02; D04H 1/00

[52] U.S. Cl. ..... 112/420; 5/343; 57/140 BY; 428/163; 428/172; 428/288; 428/361; 428/362; 428/920

[58] Field of Search ..... 428/224, 359, 362, 920, 428/361, 921, 288, 163, 172; 57/140 BY; 112/420; 5/343

[56] References Cited

U.S. PATENT DOCUMENTS

| | | | |
|---|---|---|---|
| 3,271,189 | 9/1966 | Hofmann | 428/361 |
| 3,454,422 | 7/1969 | Mead et al. | 428/361 |
| 3,628,995 | 12/1971 | Economy et al. | 428/359 |
| 3,870,590 | 3/1975 | Hurwitz | 57/140 BY |
| 4,001,477 | 1/1977 | Economy et al. | 57/140 BY |
| B 378,760 | 3/1976 | Economy et al. | 428/224 |

OTHER PUBLICATIONS

Swihart et al., Textile Chemists and Colorist, 6, (5), pp. 32–35, (1974).

*Primary Examiner*—J.C. Cannon

[57] ABSTRACT

The horizontal burning rate of polyester staple fibers coated with cured polysiloxane is reduced by incorporating small amounts (2 to 20% by weight) of an organic staple fiber that maintains its physical integrity when exposed to a small flame. The preferred fiber is poly(p-phenylene terephthalamide). This has particular application to polyester fiberfill, and articles therefrom.

9 Claims, No Drawings

POLYSILOXANE COATED POLYESTER FIBERS BLENDED WITH OTHER FIBERS TO OBTAIN FIBROUS MASS HAVING MORE ACCEPTABLE FLAME RESISTANCE THAN A MASS OF UNBLENDED POLYSILOXANE COATED FIBERS

BACKGROUND OF THE INVENTION

This invention concerns improvements in and relating to polyester fiber filling material, commonly referred to as fiberfill, and more particularly to improvements in the resistance to burning of such material and of articles, such as batts, quilted composites, fabrics, garments and other articles made therefrom.

Polyester fiberfill is used commercially in many garments and other articles, such as sleeping bags, comforters and pillows. A particularly useful and desirable form of polyester fiberfill has a coating of cured polysiloxane, e.g. as disclosed in Hofmann U.S. Pat. No. 3,271,189 and Mead et al. U.S. Pat. No. 3,454,422, because certain desirable properties, such as bulk stability and fluffability are improved thereby.

It is always desirable to reduce the flammability of fabrics and particular attention in industry has recently been directed to ensuring that camping articles, primarily tents, but also other camping articles such as sleeping bags, have burning rates below at least minimum standards. Although there are presently no Federal guidelines as to the minimum acceptable burning rate for such articles other than the 45° angle test (CS-191-53), the Canvas Products Association International (CPAI) has proposed a test procedure that has been used herein.

T. J. Swihart and P. E. Campbell have reported "How Silicones Affect Fabric Flammability" in an article in Textile Chemist and Colorist, Volume 6 (1974) pages 109–112. The object of the present invention has been to reduce the horizontal burning rate of polysiloxane-coated fiberfill subjected to a small flame, such as a candle or burning twig, without losing the desirable properties brought about by the use of the polysiloxane coating.

A recent suggestion for improving the flame-resistance of polyester fiberfill has been to coat or bond a mixture of 65 to 95% polyester and 5 to 35% of non-flammable halogen-containing polymer with a specific non-flammable halogen-containing copolymer containing up to 10% of flame-retardant halogen-containing synergist in Hurwitz South African Patent Application No. 74/6184. He notes that conventional binders often tend to increase the flammability of textile products. He warns against the use of large amounts of halogen-containing polymers in fiberfill because of the severe loss of resilience and the tendency to pack down in use. He notes that, although expensive flameproof fibers are available and have been blended with flammable fibers in an attempt to obtain less expensive textile products having non-flammable properties, the products obtained from such a mixture of polyester fibers still have deficiencies making them unsuitable for many uses if the proportion of non-flammable fibers content is high enough to make the product self-extinguishing.

It was very surprising, therefore, to find that a significant reduction in the burning rate of polysiloxane-coated polyester fiberfill articles could be achieved without significant loss of desirable characteristics merely by incorporating relatively small amounts of other fibers.

SUMMARY OF THE INVENTION

There is provided an intimate blend of staple fibers comprising by weight about 80 to 98% of polyester staple fibers having a cured polysiloxane coating and about 2 to 20% of organic staple fibers that maintain their physical integrity when exposed to the flame from a burning match, and articles, such as batts, quilted composites, fabrics, garments and other articles made therefrom.

DETAILED DESCRIPTION OF THE INVENTION

The polyester may be any of the polyesters suitable for preparing textile fibers but will preferably be a terephthalate polyester such as poly(ethylene terephthalate), poly(hexahydro-p-xylylene terephthalate) and terephthalate copolyesters in which at least 85 mole percent of the ester units are ethylene terephthalate or hexahydro-p-xylylene terephthalate units.

Suitable polysiloxane composition for use in preparing the cured polysiloxane-coated polyester fibers are, e.g., those described in U.S. Pat. Nos. 3,454,422 and 3,271,189, referred to hereinbefore.

The amount of cured polysiloxane on the polyester fibers may range from 0.01 to 5% and preferably will be from about 0.1 to about 1.5% by weight, based on fibers.

The staple fibers that are blended with the polyester fibers having a cured polysiloxane coating comprise those organic fibers that maintain their physical integrity, that is, do not, for example, melt, vaporize, shrink excessively or burn and crumble, when exposed to a small flame such as a burning match applied to a loose mass of the fibers in an ash tray. As suitable fibers, there may be mentioned poly(p-phenylene terephthalamide), which is preferred, flame-retardant rayon, novolac resins, cotton and poly(m-phenylene isophthalamide). If desired, two or more types of these fibers may be present in the blend, and a mixture of poly(p-phenylene terephthalamide) and poly(m-phenylene isophthalamide) has given an especially good result. Some of these materials are accepted as having a high resistance to flammability, but this is not the important criterion. Non-flammable halogen-containing polymers such as are disclosed in South African Patent Application No. 74/6148 lose their physical integrity by melting or shrinking away when exposed to a small flame, and are therefore unsuitable. On the other hand, cotton is suitable despite the fact that it will burn, because it will form a residual ash that preserves its physical integrity. In contrast, wool shrivels up and does not preserve its physical integrity. It is possible to test fibers empirically, e.g. by studying the effect of a small flame on the physical integrity of a loose ball thereof, to receive guidance as to their suitability, and it is also possible to test the burning rate of blends as described hereinafter.

The blends, batts, quilted composites, fabrics, garments and other articles may be made by conventional techniques, e.g. as described in U.S. Pat. No. 3,454,422.

The amount of such organic staple fibers present in the blend will range from about 2 to about 20%, and is preferably 5 to 15% by weight and especially about 10% by weight.

The flame response of the blends is determined by preparing a composite structure which simulates a filled product and exposing it to a small flame source and measuring its horizontal rate of burn. Substantial reductions in rate of burn represent a reduced hazard to a person using a sleeping bag or similar article which might be exposed to a small flame source and experience a horizontal propagating flame front. It was not expected that such relatively small amounts of the organic fibers that maintain their physical integrity when exposed to the flame would provide the highly desired reduction in burn rate in coated polyester fiberfill composites. It should be understood that the nature of other ingredients of such composites, especially the cover fabric, has an important effect.

In the following Example, all percentages are by weight, based on total weight, unless specified to the contrary.

EXAMPLE

Drawn, hollow, crimped 4.75 denier per filament staple fibers of poly(ethylene terephthalate) having a cured polysiloxane coating are combined with other fibers in the amounts indicated in the Table in approximately 1 kilogram lots and are blended by hand and then through a garnett (1953 Proctor & Schwartz Garnett Card) to produce intimately blended webs that are cross-lapped into batts of area 32 square feet (3 square meters) and weighing about one ounce per square foot (300 grams per square meter).

These batts are cut into 12-inch by 28-inch pieces (30.5 cm by 71.2 cm), and fabricated into a composite structure with the batting between two 12-inch by 28-inch (30.5 cm by 71.2 cm) pieces of downproof nylon taffeta fabric made from 70 denier filament yarns. These composite structures are sewn using spun polyester 70/3 thread (3 filaments each of 70 denier, Coates & Clark "Flame Safe"), 10 stitches per inch (4 stitches per cm) lockstitch with ¼ inch (0.6 cm) seam allowance on all four edges.

The composite structures are compressed in a chamber to ½ their original height for 24 hours. Five replicates are compressed in the same chamber at the same time. Compressed specimens are allowed to passively recover for at least 1 hour prior to testing for rate of horizontal burn.

Burn tests are conducted in a test cabinet situated in a sealed chemical hood equipped with a variable speed fan; pressure in the hood is 0.65 inch (1.65 cm) of water below atmospheric pressure. During ignition, a 140 foot (43 meter) per minute air flow is maintained outside the test cabinet. At test completion, a 1350 foot (415 meter) per minute air flow is used to clear the hood of volatile combustion products.

The rectangular test cabinet used is approximately 24 inches by 24 by 28 inches high (61 by 61 cm by 71 cm). There is a 2-inch (5.1-cm) air gap at the top and bottom of both the two metal sides and the metal back. The front is a 20-inch square (51-cm) sheet of heat resistant glass with a 4-inch (10-cm) gap at both top and bottom. The top is a solid metal plate.

For burn testing, each of the composite specimens is folded in half once to 12 by 14 inches (30 by 36 cm) and placed on a rectangular steel plate of similar overall dimensions having a section of length 10 inches by 1½ inches in depth (25.4 × 3.8 cm) cut from the front edge of length 12 inches (30 cm). The side and back edges of the specimen are compressed to 1 inch (2.5 cm) thickness with a steel clamp. The plate, with clamp and folded specimen, is supported on four legs that allow placement of a Bunsen burner beneath the center of the folded specimen edge protruding at the front. A flow of n-butane gas, unmixed with air, is adjusted to give the burner a flame which rises ¾ of an inch (1.9 cm) above the top of the steel plate and impinges on the specimen. The flame is applied for 30 seconds.

After the specimen has been ignited and has burned 1½ inches (3.8 cm) along its long dimension, a stopwatch is started. After the specimen has burned an additional 10 inches (25.4 cm) along the long dimension, the watch is stopped and the elapsed time in seconds recorded and used to calculate the rate of horizontal burn. The parting of two cotton threads with attached weights suspended across the top of the specimen 1½ and 11½ inches (3.8 and 29.2 cm) from and parallel to the front edge indicates when the stopwatch should be operated. If the first thread has not parted by the time all flames have disappeared, the specimen is considered as not ignited, i.e. there is a zero burn time and a zero burn distance. If the first thread has parted but the second thread has not parted by the time all flames have disappeared, the sample is considered as self-extinguished and the time from the parting of the first thread to the last flame going out is recorded and the distance burnt from the first thread toward the second thread is recorded.

After all five replicate specimens in a given set have been tested, the product of 60 times the sum of the five burn distances is divided by the sum of the five burn times. The result of this calculation is the average horizontal rate of burn in inches per minute for the sample set.

The Table shows the nature and amounts of the organic staple fibers used in these polysiloxane-coated polyester blends and the horizontal burn rates of these samples, such rates being at most only about half that of the polysiloxane-coated polyester control. It will be noted that the burn rate is decreased by the addition of more of the minor component. The nature of the nylon taffeta cover, however, has a limiting effect on further reduction of the burning rate of blends beyond a certain point, and it is then desirable to select a more flame-resistant cover.

In addition to the foregoing polysiloxane-coated polyester blends, a similar reduction in burning rate has been noted for composites comprising other polysiloxane-coated polyester fibers, namely such fibers of poly(-hexahydro-p-xylylene terephthalate) and of a copolyester, and using a different polysiloxane coating. Although the fibers of the samples tested in the Example had a cured polysiloxane coating in amount about 0.75%, based on the weight of the fiber, we have tested samples having differing amounts of such coating.

TABLE

| Sample | Minor Component | Amount % | Burn Rates inches/min. | (cm/min) |
|---|---|---|---|---|
| Control | — | 0 | 4.5 | (11.4) |
| 1 | MPD-I | 10 | 2.4 | (6.1) |
| 2 | Cotton | 10 | 2.2 | (5.6) |
| 3 | PPD-T | 2 | 1.9 | (4.8) |
| 4 | Novolac | 10 | 1.8 | (4.6) |
| 5 | PFR rayon | 10 | 1.6 | (4.1) |
| 6 | PFR rayon | 13 | 1.5 | (3.8) |
| 7 | PPD-T | 10 | 1.5 | (3.8) |
| 8 | PPD-T | 13 | 1.3 | (3.3) |
| 9 | 50/50 PPD-T/PFR rayon | 13 | 1.3 | (3.3) |
| 10 | 95/5 MPD-I/PPD-T | 10 | 1.0 | (2.5) |

Note MPD-I is poly(m-phenylene isophthalamide). PPD-T is poly(p-phenylene terephthalamide). The novolac fiber is sold under the tradename "Kynol" by Carborundum Corporation. PFR is a flame retardant rayon sold by FMC Corporation.

What is claimed is:

1. An intimate blend of staple fibers comprising by weight about 80 to 98% of polyester staple fibers having a cured polysiloxane coating and about 2 to 20% of organic staple fibers that maintain their physical integrity when exposed to the flame from a burning match.

2. A blend according to claim 1, wherein the said organic staple fiber is poly(p-phenylene terephthalamide).

3. A blend according to claim 1, wherein the said organic staple fiber is flame-retardant rayon.

4. A blend according to claim 1, wherein the said organic staple fiber is a phenolic fiber of a novolac resin.

5. A blend according to claim 1, wherein the said organic staple fiber is cotton.

6. A blend according to claim 1, wherein the said organic staple fiber is poly(m-phenylene isophthalamide).

7. A batt comprising a blend according to claim 1.

8. A quilted composite comprising a blend according to claim 1.

9. A fabric comprising a blend according to claim 1.

* * * * *